US005155981A

United States Patent [19]

Tordini

[11] Patent Number: 5,155,981

[45] Date of Patent: Oct. 20, 1992

[54] DEVICE FOR TRANSFERRING BLISTER PACKS FROM A CUTTING STATION TO A BLISTER PACK INFEED CONVEYOR

[75] Inventor: Fausto Tordini, Imola, Italy

[73] Assignee: I.M.A. Industria Macchine Automatiche S.P.A., Bologna, Italy

[21] Appl. No.: 707,574

[22] Filed: May 30, 1991

[30] Foreign Application Priority Data

Jun. 7, 1990 [IT] Italy ..... 3544 A/90

[51] Int. Cl.[5] ..... B65B 47/00; B65B 61/06

[52] U.S. Cl. ..... 53/559; 83/152; 83/154; 198/468.4; 414/737

[58] Field of Search ..... 198/468.4, 735.3; 414/737; 53/540, 541, 247, 238, 258, 559, 467, 471; 83/152, 154

[56] References Cited

U.S. PATENT DOCUMENTS

| | | | |
|---|---|---|---|
| 3,440,794 | 4/1969 | Mueller | 53/471 |
| 3,494,482 | 2/1970 | Lense | 198/468.4 X |
| 3,593,492 | 7/1971 | Frankefort | 53/559 |
| 3,628,303 | 12/1971 | Graham | 53/559 X |
| 3,645,198 | 2/1972 | Field | 198/468.4 X |
| 3,660,962 | 5/1972 | Bliss et al. | 53/559 X |
| 3,874,143 | 4/1975 | Braber | 53/559 X |
| 4,141,457 | 2/1979 | Nocek | 414/737 |
| 4,338,083 | 7/1982 | Andrae | 83/152 X |
| 4,917,663 | 4/1990 | Pazdernik | 414/737 X |
| 4,958,722 | 9/1990 | Kobayashi et al. | 198/735.3 |

FOREIGN PATENT DOCUMENTS

| | | |
|---|---|---|
| 8414048 | 7/1984 | Fed. Rep. of Germany . |
| 2457807 | 12/1980 | France . |

*Primary Examiner*—Horace M. Culver
*Attorney, Agent, or Firm*—Darby & Darby

[57] ABSTRACT

A device comprises an arm pivoting on and supported by a shaft positioned between a station, where a sealed blister strip is cut into individual blister packs, and a blister pack infeed conveyor. The arm is made up of two pieces fitted with suction cups, and oscillates between two positions, so that in a first position the suction cups are at the cutting station, on a smooth surface of a blister pack just cut, while in a second position they are at the side of a pickup bucket, on the infeed conveyor. The suction cups are actuated in the first position, so that the blister pack can be picked up, and then the suction cups are disenabled in the second position, so that the blister pack can be fed into the bucket, with deep-drawn blisters turned upwards. Sidepieces provide for centering the blister pack in respect of the longitudinal axis of said infeed conveyor, while infeeding the blister pack into the bucket.

4 Claims, 3 Drawing Sheets

DEVICE FOR TRANSFERRING BLISTER PACKS FROM A CUTTING STATION TO A BLISTER PACK INFEED CONVEYOR

BACKGROUND OF THE INVENTION

This invention relates to the manufacturing of automatic packaging machine for packaging of various kinds of products into individual packs obtained by cutting a sealed strip provided with deep-drawn blisters. These individual packs are usually known as blister packs.

Medicines, capsules, tablets, pills, etc. are products particularly suited to be packaged into these blister packs.

The machines for packaging these products shape blisters into a strip of heat-shapeable material, and then fill the blisters with the products.

After filling, the blister strip is then pulled through a station to check that the products are inside the blisters (if necessary this can also be fitted with parts to detect whether the blisters are full), passed through a station which applies aluminium foil to seal the surface of the strip at the opening of the blisters, and lastly passed through a cutting station where the sealed blister strip is cut into individual blister packs.

Connected to, or downstream from, the cutting station there is equipment to form a stack of blister packs ready to be fed into a container (or carton) positioned on a line of containers moving in phase correlation with both the machine packaging the blister packs, and also with the cutting station and other parts.

DESCRIPTION OF THE PRIOR ART

According to a known packaging machine, for packaging products into individual packs obtained by cutting a sealed strip with deep-drawn blisters, the strip is fed horizontally (with the blisters turned downwards) into the cutting station.

Here the cutter moves upwards and the blister pack formed by the cutting action is transferred upwards by an elevator which is coaxially inserted in the cutter and driven in synchronism with it.

The blister pack raised in this way goes to touch and pushes aside spring-loaded retainer fittings, designed to support the blister pack, or the blister packs, once the elevator has been lowered.

A stack of blister packs will gradually be formed on these fittings and once completed the stack is then conveyed to one side by a pusher and passed to a stack infeed conveyor that brings the stack to a carton.

However, this version does present some manufacturing complications in that it is not possible for any individual blister packs that are faulty to be rejected; any faulty blister packs will either have to be rejected with the entire newly-formed stack, or with the carton containing the stack.

The stack is formed with the blisters turned downwards; this means that the weight of the whole stack is resting on the blisters of the bottom blister pack, which obviously will not make the stack very stable.

Another known machine, provides for the blister strip being fed horizontally to the cutting station (blister side down) but the cutter moving downwards; this means that blister packs made in this way will drop onto the blister pack infeed conveyor positioned below the cutting station and then they will be fed to the parts forming the stack.

These blister packs are positioned onto the infeed conveyor with the blisters turned downwards, which means they cannot be inspected (inspection may be requested and/or carried out during packaging).

Furthermore, the blister-packs are not perfectly centered as they are positioned on the infeed conveyor (i.e. they are not symmetrical to the longitudinal axis of the conveyor); this is because the blister packs are transferred from the cutting station and dropped directly onto the conveyor without further control or means of guidance.

This conveyor is also the place where any faulty blister packs will be rejected by rejection equipment which acts onto the faulty blister packs by lateral force as they progress along the infeed conveyor, thus removing any faulty packs from the conveyor.

Obviously, this will not be facilitated by the fact that the blister packs are only supported by the blisters, as has already been mentioned.

These factors will obviously limit the running speed of the conveyor.

In yet another known device the blister strip is fed vertically into the cutting station and the cutters operate parallel to the direction the blister packs are being pulled along the conveyor in.

Above the conveyor is an arm, whose one end is fitted with pressure suction cups; this end of the arm pivots vertically and diagonally in relation to said direction, and for a short distance it advances parallel to the latter direction.

In one of the typical positions the suction cups are positioned in the cutting station where they pick up the flat surface of the newly-formed blister pack.

The arm is then conveyed lengthways downstream and then rotated downwards so that the suction cups are positioned above the conveyor, with the blister packs blister-side down; by disenabling the suction cups, transfer of the blister pack is complete, and the pack will consequently remain on the conveyor with the blister turned downwards.

The device that has just been described presents the same complications as the previous one; furthermore the inertia of the diagonal and pivoting arms obviously limits the running speed of blister pack transfer operations.

If the blister packs were placed on the conveyor with the blister turned upwards, some of these difficulties would be overcome; this would also allow inspection of the blisters and would not prevent the ejection of any faulty blister packs.

In one of the known versions this is obtained through a design feature, which, however complicates the procedure and makes the packaging machine larger.

In this device the blister strip is made to rotate on rollers at an angle of 180 degrees from the sealing station to the cutting station, so that the blister strip is fed horizontally, with the blister turned upwards to the cutting station; in the cutting station the cutter moves downwards.

SUMMARY OF THE INVENTION

The object of this invention is to propose a device capable of transferring blister packs from a cutting station to a blister pack infeed conveyor, with the blisters turned upwards, and in such a way that the blister packs are in constant contact with the parts manipulating them.

A further object of this invention, is to propose a device capable of positioning blister packs on said conveyor, with the blisters turned upwards, in a pre-determined position perfectly centered in relation to the longitudinal axis of the infeed conveyor.

Another object of this invention, is to propose a device capable of doing all of the above, regardless of which direction the cutting station is facing in and the size of the blister packs, i.e. a universal device.

The invention achieves these objects by means of a device for transferring blister packs from a cutting station to a blister pack infeed conveyor, mounted in a machine for packaging products in blister packs.

The machine comprises:

a forming station, for shaping blisters into a strip of heat-shapeable material;

a filling station for filling said blisters with products;

a sealing station for applying film and sealing a side of said blister trip where blister openings are;

a cutting station, where said sealed blister strip is cut into individual blister packs;

an infeed conveyor with an upper surface positioned upstream of said cutting station.

The device subject of this invention includes:

one arm, having one end pivoted on and supported by a shaft, and a remaining end provided with holding means, said arm being made to oscillate so that said holding means are moved from said cutting station, resting on a smooth surface of a blister pack being cut from said blister strip, and an initial part of said upper surface of said infeed conveyor, so that said blister pack is picked up, with the blisters turned upwards and transferred to said infeed conveyor;

two first fixed longitudinal sidepieces, connected to said upper surface and protruding downstream of said initial part of said upper surface, said fixed sidepieces bearing longitudinal grooves designed to receive and guide longitudinal edges of said blister packs resting on said upper surface;

second sidepieces, located upstream of said fixed sidepieces and featuring longitudinal slots respectively aligned to said grooves, said second sidepieces being shaped in such a way as to receive said longitudinal edges of said blister packs by snap insertion into said slots, when said holding means are in said second position, with subsequent centering of said blister pack in relation to a longitudinal axis of said upper surface.

BRIEF DESCRIPTION OF THE DRAWINGS

This invention is subsequently explained in greater detail in the following description with specific reference to the enclosed drawings.

DESCRIPTION OF THE PREFERRED EMBODIMENT

Figure 1:
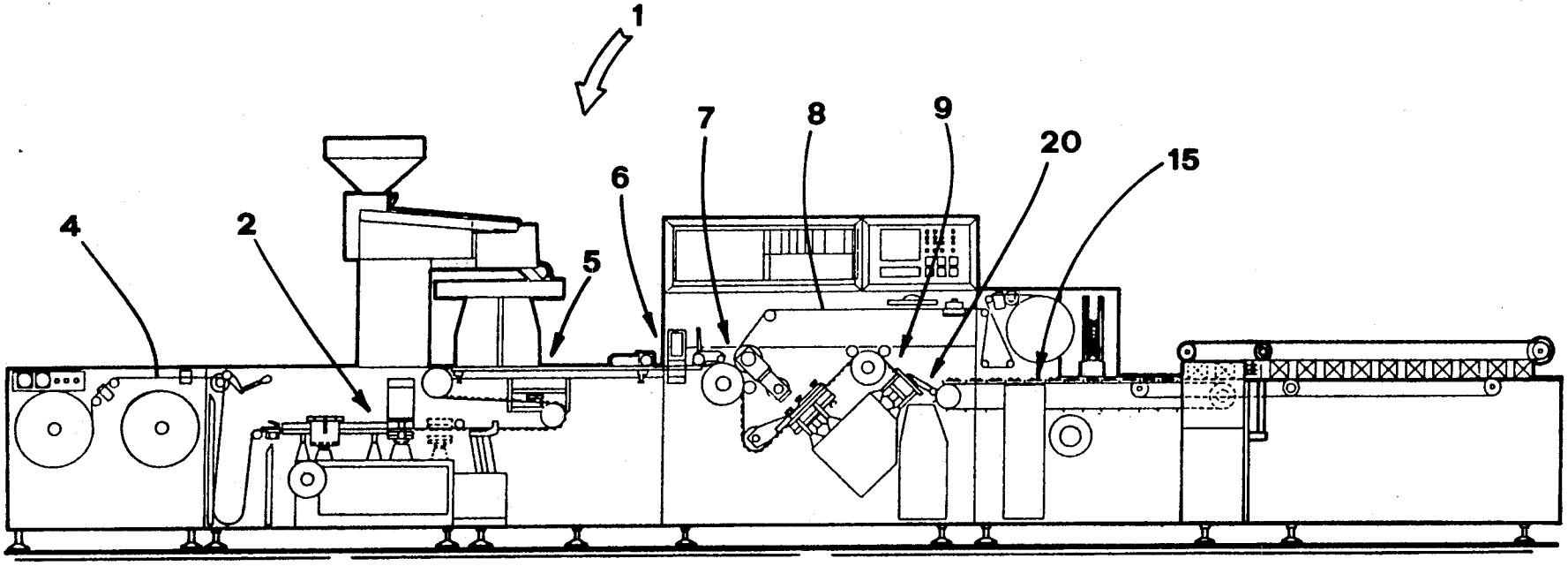
FIG. 1 is a diagram showing a side view of a machine for packaging various products into individual blister packs, the device described in this invention is downstream from this machine.

The above drawings show a machine 1, consisting of the following parts now described upstream to downstream:

a station 2 for shaping the blisters 3 onto a strip 4, of heat-shapeable material;

a station 5 for filling the blisters 3, with the products in question (not shown), such as capsules, tablets, etc.;

a station 7 for applying a sealing film 8 to the side of the strip 4 where the blister openings are;

a station 9 for cutting the sealed blister strip 10 into individual blister packs 11.

The cutting station 9 (FIG. 2) is inclined, and slopes downwards upstream to downstream.

The cutting station 9 consists of cutters 12, which are mobile alternately in the direction of S, and in conjunction with the matrix 13, in a way which is known and with mobile parts 30 designed to hold the blister strip against the edge of the matrix 13, which faces the cutters 12.

At this station the blister strip 10 is driven, with the blisters 3 turned downwards, by intermittent motion.

Downstream from this station 9 there is an upper surface 14 of a continuous conveyor 15, consisting of two adjacent belts 15*a* and 15*b*.

Each of these belts is fitted on the outside with crosspieces 16, protruding over the adjacent belt so as to cover the entire width of the upper surface.

The consecutive crosspieces of the belts cooperate to outline the pickup buckets 17 (as better described hereinafter) for receiving the blister packs 11.

At either side of the upper surface 14 there are two fixed sidepieces 35 located symmetrical to the longitudinal axis of the surface 14.

The fixed sidepieces 35 are connected on the inside to the longitudinal grooves 36 receiving the longitudinal edges 11*b* (as better described hereinafter) of the blister packs 11 being placed in these buckets 17.

The fixed sidepieces 35 start at the initial part of the upper surface 14 (see FIGS. 2 and 3) and extend downstream, in respect of the surface proceeding in the direction of N.

Figure 4:
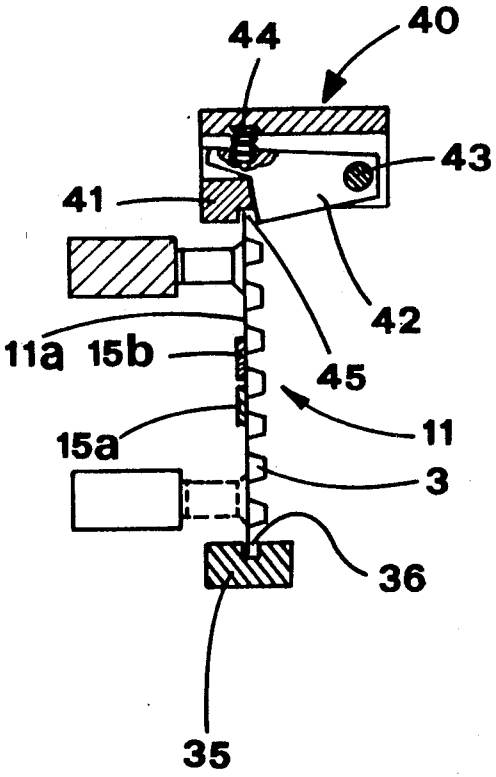
FIG. 4 is a diagram showing the IV—IV section of FIG. 3.

Immediately upstream from these sidepieces 35 there are two second sidepieces 40 (see FIG. 4) connected to the initial part of the upper surface 14.

Each of these sidepieces 40 is made up of a lower fixed part 41 and an upper mobile part 42, pivoting on a shaft 43 which is parallel to the direction N and which it can oscillate against with spring fittings 44.

Both parts 41 and 42 define a longitudinal slot 45; the longitudinal slot 45 is aligned to the grooves 36 of the fixed sidepieces 35.

The device which is the subject of this invention, indicated by the reference number 20, is located and operates between the cutting station 9 and the initial part of the conveyor upper surface 14.

The device 20 consists of an arm 21 pivoting and supported by a shaft 22, positioned between the station 9 and the initial part of the upper surface 14.

The shaft 22 is placed at a lower level in respect of the surface 14, and is parallel to the axis 18 of the wheel 19, which the belts 15*a* and 15*b* partly turn around.

The arm 21 consists of two parallel and identical pieces 23*a* and 23*b*, positioned in corresponding working spaces respectively at either side of the upper surface 14.

The ends of said pieces are fitted with holding means, such as suction cups 24*a* and 24*b*, which, according to a known way, can be connected to a source of vacuum, which is not shown; the axes of the suction cups are perpendicular in respect of the respective pieces 23*a* and 23*b*.

The arm 21 oscillates by the action of known parts (these are not shown since they are not relevant to the invention) in directions H and K.

Figure 2:
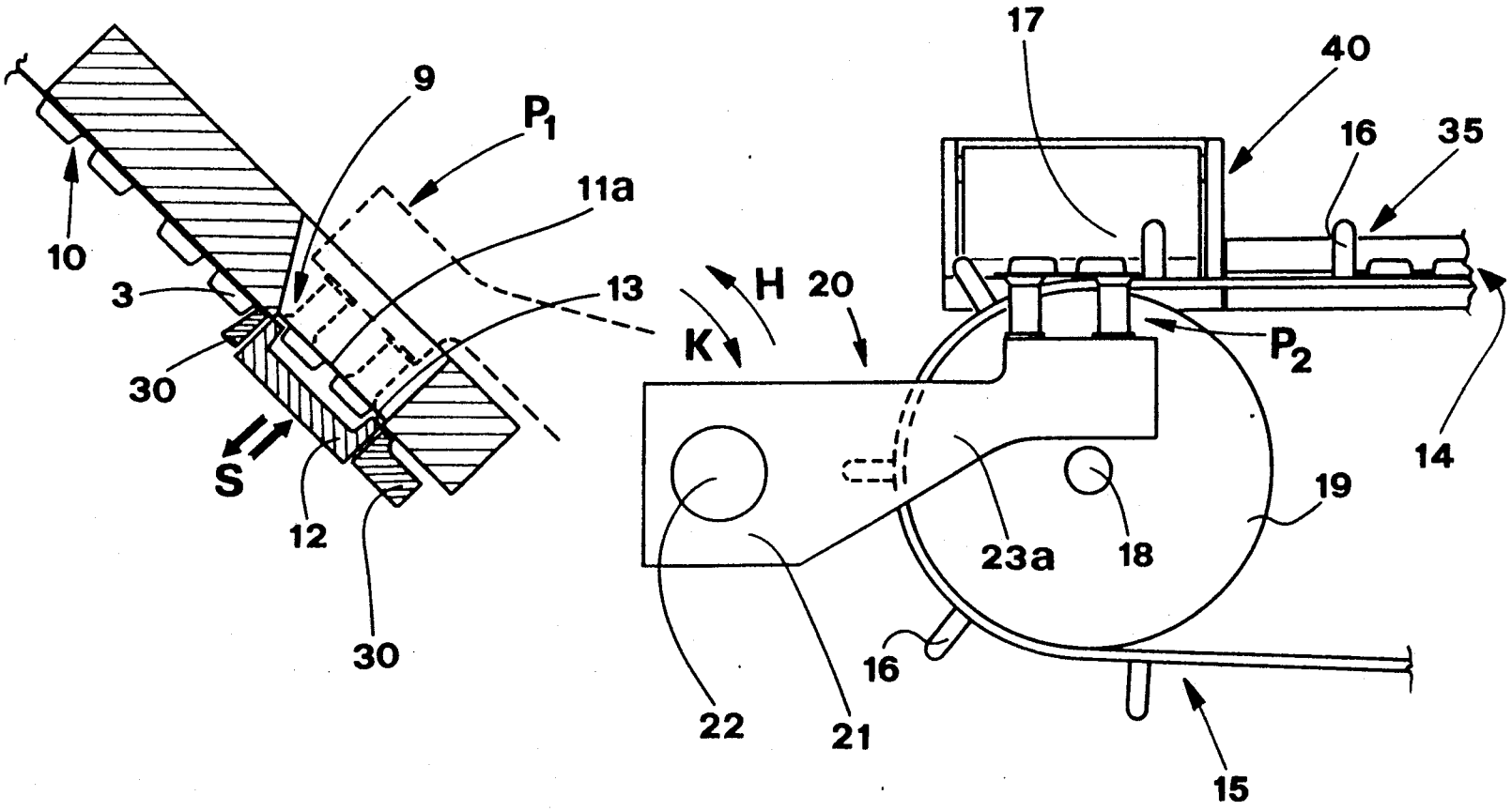
FIG. 2 is a side view of said device, partly in cross-section and on a larger scale than in FIG. 1.
Figure 3:
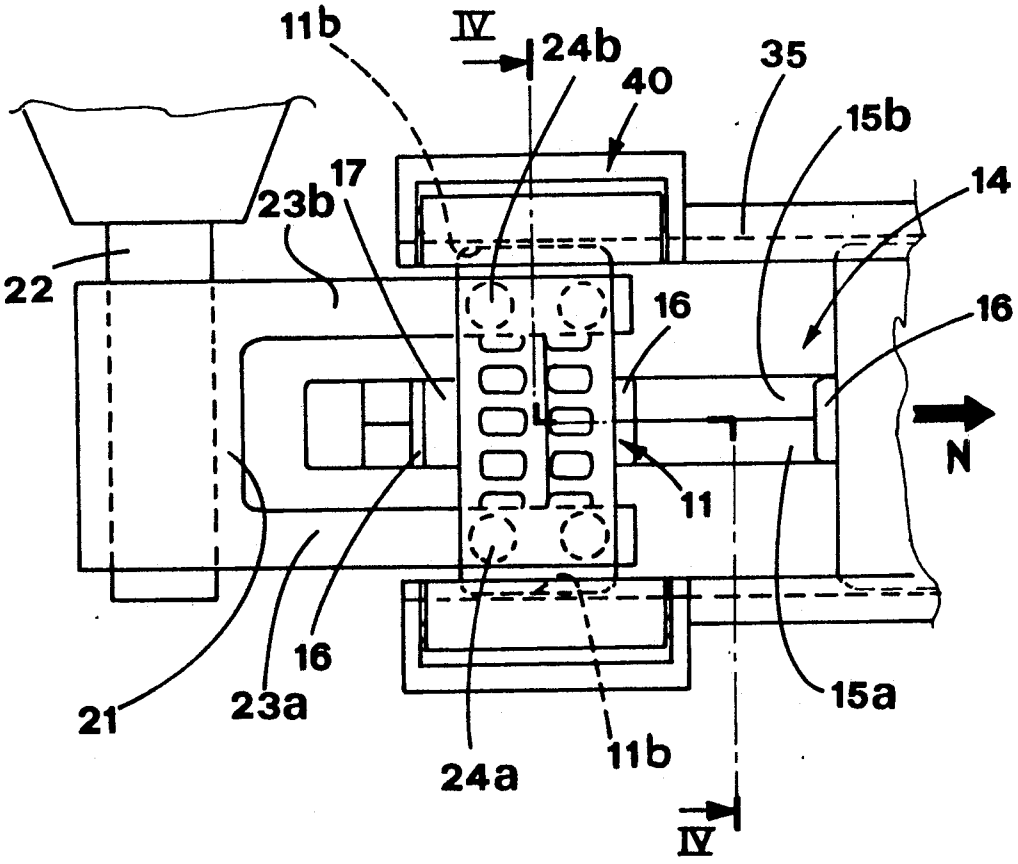
FIG. 3 is a diagram showing a view from above of part of what is shown in FIG. 2.

The length of pieces 23*a* and 23*b* and the position of the shaft 22, in relation to the cutting station 9 and the upper surface 14, enable the suction cups 24*a* and 24*b* to be positioned at the station 9 (see FIG. 2 for the first position P1).

After that the arm 21 has rotated towards K, the suction cups are positioned at either side of the upper surface 14 (see FIG. 2 for the second position, P2) and between the sidepieces 40.

The blister strip 10, as has been mentioned, is driven by intermittent motion; the arm 21 oscillates in phase correlation with the operation of the cutting station 9.

The suction cups 24*a*, 24*b* are moved to the first position P1 when the blister strip 10 is cut by the cutter 12 and the matrix 13.

This cutting action is optimized by stopping the strip 10 against the matrix 13 by the parts 30.

The conveyor belt 15 is driven by intermittent motion in phase correlation with the oscillations of the arm 21.

When the suction cups 24*a*, 24*b* are moved to the second position P2, a bucket 17 is made available on the conveyor 15 for receiving a blister pack 11, that is brought by the suction cups between the sidepieces 40.

The working way of the device is already clear from the above description, and is further explained in the following.

When the suction cups 24*a* and 24*b* are in the first position P1, they are located at the cutting station, directly touching the smooth surface 11*a* of the blister pack 11 being cut from the blister strip 10.

At this point the suction cups are actuated so that they pick up the blister pack 11 just cut.

Then the arm 21 are rotated in the direction K until the suction cups reach the second position P2.

Upstream from this position the longitudinal edges 11*b* of the blister pack 11 strike the mobile parts 42 of the sidepieces 40 which rotate on the outside against the spring fittings 44 they are connected to, thus facilitating snap insertion of the edges 11*b* into the slots 45.

This way the blister pack 11 is centered in respect of the longitudinal axis of the conveyor 15 and placed in the bucket 17.

The centering is optimized by the action of the slots 45, of the sidepieces 40, and is subsequently maintained by the action of the grooves 36 of the sidepieces 35, which are consecutive to and aligned with the slots 45.

This means that the smooth surface 11*a* of the blister pack that has just been transferred, is in touch with the bottom of the bucket 17, where it has finally come to rest as a result of the suction cups being disenabled.

The conveyor 15 is advanced by one step and the arm 21 is then rotated in the direction H, so that the suction cups return once more to the first position P1 and a new cycle of blister pack transfer may now commence in exactly the same way as the one that has just been described.

The blister pack 11 placed in the bucket 17 is with the blisters turned upwards, and this has several advantages.

It is possible for the blister packs to be inspected while still on the conveyor and, what is more, the smooth surfaces 11*a* of the blister packs are resting on the bottom of the buckets 17, thus facilitating rejection of any faulty blister packs from the conveyor, if necessary.

The device proposed enables optimal positioning of the blister packs 11 in their buckets; and these positions can be maintained while the conveyor is being advanced by intermittent motion, since they are assisted by the contact between the two smooth surfaces, i.e. the smooth surface 11*a* of the blister packs and the smooth support surface of the bucket 17.

The fact that the blister packs are in their buckets 17, with the blisters turned upwards facilitates stacking of the blister packs which is carried out by an identical device connected to the conveyor belt 15; this device could be of the sort mentioned in Italian patent application No. 3543A/90 filed on Jun. 7th, 1990 by the same applicant.

In this case the cutting station has been considered to be inclined as is shown in the drawings enclosed.

It can also be possible for this station to be advanced from the vertical to the horizontal; provided that the pivoting angle of the arm 21 is varied accordingly.

Similar considerations would have to be made in cases where the upper surface 14 of the conveyor belt 15 is not horizontal.

Neither does the variation with the distance between the cutting station 9 and the first part of the upper surface 14 of the conveyor belt 15 provoke any particular difficulties, since the pieces 23*a* and 23*b* can be replaced with ones of appropriate length and the shaft 22 can be positioned accordingly.

With any variations in the format of the blister packs it is be sufficient to ensure that a suitable amount of suction cups is used to optimize the pickup of the blister pack and its insertion into the bucket 17.

Obviously any variation in format means that the cutting parts of the station 9 have to be changed, and the length of the bucket 17 has to be varied accordingly (for example by adjusting the two belts forming the conveyor); this is not shown in detail, however, since it is not of relevance to this invention.

The device proposed transfers the blister packs from the cutting station 9 to the conveyor 15, with the blisters turned upwards, the advantages of this having been mentioned previously.

As has been shown, the device works regardless of what shape and/or which direction the cutting station 9 and upper surface 14 of the conveyor 15 are facing in, and with any kind of format whatsoever, which means it is universal.

Neither are any modifications either to the machine 1 or to the conveyor 15, necessary for this device to work, since it only depends on these parts for its motion, this being a further technical advantage of the design suggested.

The above description is intended purely in terms of exemplification, so any variations in practice from the above technical description are to be considered within the terms of this application and the following claims.

What is claimed is:

1. In a machine for packaging products in blister packs having:

a forming station for shaping blisters into a strip of heat-shapeable material, a filling station for filling said blisters with products, a sealing station for applying film and sealing the side of said blister strip with the blister openings, a cutting station where said sealed blister strip is cut into individual blister packs, an infeed conveyor with an upper surface positioned upstream of said cutting station;

means for transferring blister packs from said cutting station to the infeed conveyor from said cutting station comprising:

means for holding a cut blister pack at said cutting station with the blister thereof facing in a generally downward direction;

an arm having one end pivoted on and supported by a shaft and the other end carrying said holding means; and means for oscillating said arm to move said holding means from said cutting station and to transfer the cut blister pack to said infeed conveyor with the blister facing upward.

2. A machine as in claim 1 wherein said infeed conveyor has an upper surface with an initial part onto which the blister pack is placed by said arm with the blister pack film strip thereon, two first fixed longitudinal first sidepieces connected to said upper surface and extending downstream of said initial part of said upper surface, said first sidepieces having longitudinal grooves to receive and guide longitudinal edges of said blister packs resting on said upper surface; and second sidepieces located upstream of said first sidepieces and having longitudinal slots respectively aligned to said grooves, said second sidepieces shaped to receive said longitudinal edges of said blister packs by snap insertion into said slots, when said holding means are in said second position, with subsequent centering of said blister pack in relation to a longitudinal axis of said upper surface.

3. A machine according to claim 2, wherein said holding means comprises vacuum operated suction cups.

4. A machine according to claim 1, wherein each of said second sidepieces comprises:

a lower fixed part and an upper movable part, means for oscillating said upper part in a direction parallel to the direction of travel of the packs on the infeed conveyor upper surface, spring fittings acting on said upper part, said fixed lower part and movable upper part form said longitudinal slots.

* * * * *